US009194046B2

(12) United States Patent
Hoppe et al.

(10) Patent No.: US 9,194,046 B2
(45) Date of Patent: Nov. 24, 2015

(54) METHOD FOR PRODUCING SEMICONDUCTING INDIUM OXIDE LAYERS, INDIUM OXIDE LAYERS PRODUCED ACCORDING TO SAID METHOD AND THEIR USE

(75) Inventors: Arne Hoppe, Herne (DE); Alexey Merkulov, Ludwigshafen (DE); Juergen Steiger, Duesseldorf (DE); Duy Vu Pham, Oberhausen (DE); Yvonne Damaschek, Recklinghausen (DE); Heiko Thiem, Bensheim (DE)

(73) Assignee: Evonik Degussa GmbH, Essen (DE)

( * ) Notice: Subject to any disclaimer, the term of this patent is extended or adjusted under 35 U.S.C. 154(b) by 623 days.

(21) Appl. No.: 13/201,107

(22) PCT Filed: Feb. 5, 2010

(86) PCT No.: PCT/EP2010/051432

§ 371 (c)(1),
(2), (4) Date: Aug. 29, 2011

(87) PCT Pub. No.: WO2010/094583

PCT Pub. Date: Aug. 26, 2010

(65) Prior Publication Data

US 2011/0315982 A1 Dec. 29, 2011

(30) Foreign Application Priority Data

Feb. 17, 2009 (DE) ..... 10 2009 009 337

(51) Int. Cl.

| | |
|---|---|
| ***H01L 51/40*** | (2006.01) |
| ***H01L 21/44*** | (2006.01) |
| ***C23C 18/12*** | (2006.01) |

(52) U.S. Cl.

CPC ..... *C23C 18/1216* (2013.01)

(58) Field of Classification Search

USPC ..... 252/519.21, 1; 257/43; 106/287.18; 556/1; 438/99, 608, 658

See application file for complete search history.

(56) References Cited

U.S. PATENT DOCUMENTS

| | | | | |
|---|---|---|---|---|
| 5,342,648 | A * | 8/1994 | MacKenzie et al. | 427/126.3 |
| 7,381,633 | B2 * | 6/2008 | Thompson et al. | 438/608 |
| 2006/0188657 | A1 * | 8/2006 | Kimura et al. | 427/407.2 |
| 2008/0233378 | A1 | 9/2008 | Luthge et al. | |
| 2010/0132788 | A1 | 6/2010 | Petrat et al. | |
| 2011/0193084 | A1 | 8/2011 | Thiem et al. | |
| 2012/0213980 | A1 | 8/2012 | Arning et al. | |

FOREIGN PATENT DOCUMENTS

| | | | |
|---|---|---|---|
| EP | 2 045 359 | A1 | 4/2009 |
| JP | 2007-042689 | * | 2/2007 |
| JP | 2007 042689 | | 2/2007 |
| WO | WO 2008/007469 | A1 | 1/2008 |
| WO | 2008 113632 | | 9/2008 |
| WO | 2011 020781 | | 2/2011 |
| WO | 2011 020792 | | 2/2011 |

OTHER PUBLICATIONS

U.S. Appl. No. 13/516,900, filed Jun. 18, 2012, Steiger, et al.
U.S. Appl. No. 13/515,007, filed Jun. 11, 2012, Steiger, et al.
U.S. Appl. No. 13/391,114, filed Feb. 17, 2012, Steiger, et al.
U.S. Appl. No. 13/390,840, filed Feb. 16, 2012, Steiger, et al.
International Search Report issued Jul. 26, 2010 in PCT/EP10/051432 filed Feb. 5, 2010.
U.S. Appl. No. 13/148,967, filed Aug. 11, 2011, Steiger, et al.
U.S. Appl. No. 13/809,322, filed Jan. 9, 2013, Steiger, et al.
U.S. Appl. No. 13/809,423, filed Jan. 10, 2013, Steiger, et al.
U.S. Appl. No. 14/348,948, filed Apr. 1, 2014, Steiger, et al.

* cited by examiner

*Primary Examiner* — Monique Peets
(74) *Attorney, Agent, or Firm* — Oblon, McClelland, Maier & Neustadt, L.L.P.

(57) ABSTRACT

The present invention relates to a process for producing semiconductive indium oxide layers, in which a substrate is coated with a liquid, anhydrous composition comprising a) at least one indium alkoxide and b) at least one solvent, optionally dried and thermally treated at temperatures greater than 250° C., to the layers producible by this process, and to the use thereof.

15 Claims, 2 Drawing Sheets

Figure 1:
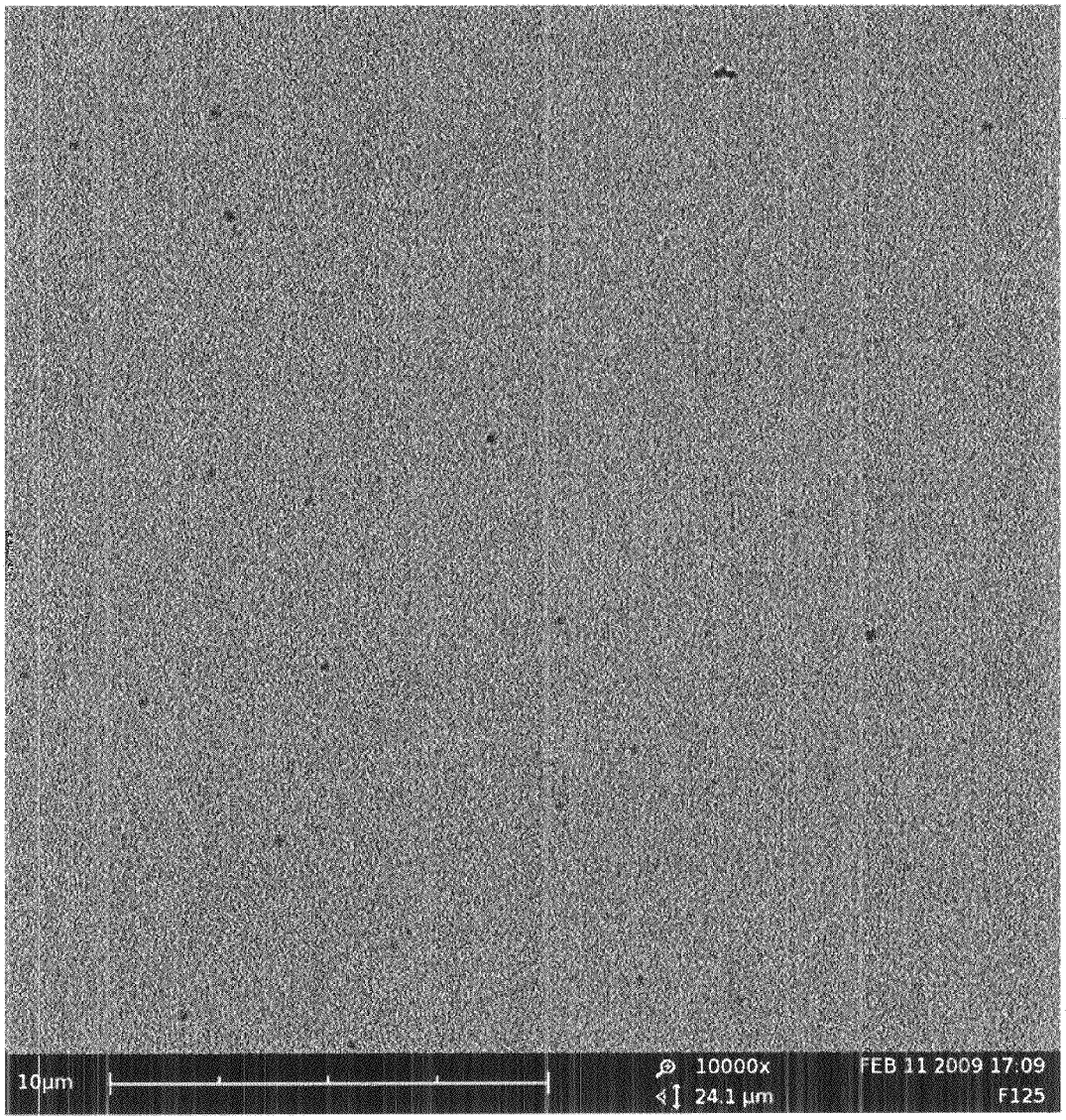

METHOD FOR PRODUCING SEMICONDUCTING INDIUM OXIDE LAYERS, INDIUM OXIDE LAYERS PRODUCED ACCORDING TO SAID METHOD AND THEIR USE

The present invention relates to processes for producing semiconductive indium oxide layers, to indium oxide layers which can be produced using the process according to the invention and to the use thereof.

The preparation of semiconductive electronic component layers by means of printing processes enables much lower production costs compared to many other processes, for example Chemical Vapour Deposition (CVD), since the semiconductor can be deposited here in a continuous printing process. Furthermore, at low process temperatures, there is the possibility of working on flexible substrates, and possibly (in particular in the case of very thin layers and especially in the case of oxidic semiconductors) of achieving optical transparency of the printed layers. Semiconductive layers are understood here and hereinafter to mean layers which have charge mobilities of 1 to 50 $cm^2/Vs$ for a component with a channel length of 20 μm and a channel width of 1 cm at gate-source voltage 50 V and source-drain voltage 50 V.

Since the material of the component layer to be produced by means of printing processes crucially determines the particular layer properties, the selection thereof has an important influence on any component containing this component layer. Important parameters for printed semiconductor layers are the particular charge carrier mobilities thereof, and the processibilities and processing temperatures of the printable precursors used in the course of production thereof. The materials should have good charge carrier mobility and be producible from solution and at temperatures significantly below 500° C. in order to be suitable for a multitude of applications and substrates. Likewise desirable for many novel applications is optical transparency of the semiconductive layers obtained.

Owing to the large band gap between 3.6 and 3.75 eV (measured for layers applied by vapour deposition) [H. S. Kim, P. D. Byrne, A. Facchetti, T. J. Marks; *J. Am. Chem. Soc.* 2008, 130, 12580-12581], indium oxide (indium(III) oxide, $In_2O_3$) is a promising semiconductor. Thin films of a few hundred nanometers in thickness may additionally have a high transparency in the visible spectral range of greater than 90% at 550 nm. In extremely highly ordered indium oxide single crystals, it is additionally possible to measure charge carrier mobilities of up to 160 $cm^2/Vs$. To date, however, it has not been possible to achieve such values by processing from solution [H. Nakazawa, Y. Ito, E. Matsumoto, K. Adachi, N. Aoki, Y. Ochiai; *J. Appl. Phys.* 2006, 100, 093706. and A. Gupta, H. Cao, Parekh, K. K. V. Rao, A. R. Raju, U. V. Waghmare; *J. Appl. Phys.* 2007, 101, 09N513].

Indium oxide is often used in particular together with tin (IV) oxide ($SnO_2$) as the semiconductive mixed oxide ITO. Owing to the comparatively high conductivity of ITO layers with simultaneous transparency in the visible spectral region, one use thereof is that in liquid-crystal displays (LCDs), especially as "transparent electrode". These usually doped metal oxide layers are produced industrially in particular by costly vapour deposition methods under high vacuum. Owing to the great economic interest in ITO-coated substrates, there now exist some coating processes, based on sol-gel techniques in particular, for indium oxide-containing layers.

In principle, there are two options for the production of indium oxide semiconductors via printing processes: 1) particle concepts in which (nano)particles are present in printable dispersion and, after the printing operation, are converted to the desired semiconductor layer by sintering operations, and 2) precursor concepts in which at least one soluble precursor, after being printed, is converted to an indium oxide-containing layer. The particle concept has two important disadvantages compared to the use of precursors: firstly, the particle dispersions have colloidal instability which necessitates the use of dispersing additives (which are disadvantageous in respect of the later layer properties); secondly, many of the usable particles (for example owing to passivation layers) only incompletely form layers by sintering, such that some particulate structures still occur in the layers. At the particle boundary thereof, there is considerable particle-particle resistance, which reduces the mobility of the charge carriers and increases the general layer resistance.

There are various precursors for the production of indium oxide layers. For example, in addition to indium salts, it is also possible to use indium alkoxides as precursors for the production of indium oxide-containing layers.

For example, Marks et al. describe components which have been produced using a precursor solution of $InCl_3$ and of the base monoethanolamine (MEA) dissolved in methoxyethanol. After spin-coating of the solution, the corresponding indium oxide layer is obtained by a thermal treatment at 400° C. [H. S. Kim, P. D. Byrne, A. Facchetti, T. J. Marks; *J. Am. Chem. Soc.* 2008, 130, 12580-12581 and supplemental information].

Compared to indium salt solutions, indium alkoxide solutions have the advantage that they can be converted to indium oxide-containing coatings at lower temperatures.

Indium alkoxides and the synthesis thereof have been described since as early as the 1970s. Mehrotra et al. describe the preparation of indium trisalkoxide $In(OR)_3$ from indium (III) chloride ($InCl_3$) with Na—OR where R represents methyl, ethyl, isopropyl, n-, s-, t-butyl and -pentyl radicals [S. Chatterjee, S. R. Bindal, R. C. Mehrotra; *J. Indian Chem. Soc.* 1976, 53, 867].

Bradley et al. report a similar reaction to Mehrotra et al. and obtain, with virtually identical reactants ($InCl_3$, isopropylsodium) and reaction conditions, an indium-oxo cluster with oxygen as the central atom [D. C. Bradley, H. Chudzynska, D. M. Frigo, M. E. Hammond, M. B. Hursthouse, M. A. Mazid; *Polyhedron* 1990, 9, 719].

Hoffman et al. disclose an alternative synthesis route to indium isopropoxide and obtain, in contrast to Mehrotra et al., an insoluble white solid. They suspect a polymeric substance $[In(O\text{-}iPr)_3]_n$ [S. Suh, D. M. Hoffman; *J. Am. Chem. Soc.* 2000, 122, 9396-9404].

Many processes for producing indium oxide-containing coatings via precursor processes are based on sol-gel techniques in which metallate gels producible from precursors are converted by a conversion step to the corresponding oxide layers.

For instance, JP 11-106934 A (Fuji Photo Film Co. Ltd.) describes a process for producing a transparent conductive metal oxide film on a transparent substrate via a sol-gel process, in which a metal alkoxide or a metal salt, preferably an indium alkoxide or indium salt, is hydrolysed in solution below 0° C., and then the hydrolysate is heated.

JP 06-136162 A (Fujimori Kogyo K.K.) describes a process for producing a metal oxide film from solution on a substrate, in which a metal alkoxide solution, especially an indium isopropoxide solution, is converted to a metal oxide gel, applied to a substrate, dried and treated with heat, in which UV radiation is effected before, during or after the drying and heat treatment step.

JP 09-157855 A (Kansai Shin Gijutsu Kenkyusho K.K.) also describes the production of metal oxide films from metal alkoxide solutions via a metal oxide sol intermediate, which are applied to the substrate and converted to the particular metal oxide by UV radiation. The resulting metal oxide may be indium oxide.

CN 1280960 A describes the production of an indium tin oxide layer from solution via a sol-gel process, in which a mixture of metal alkoxides is dissolved in a solvent, hydrolysed and then used to coat a substrate with subsequent drying and curing.

A common feature of the sol-gel processes, however, is that their gels are unsuitable for use in printing processes owing to high viscosity and/or, especially in the case of solutions of low concentration, the resulting indium oxide-containing layers have inhomogeneities and hence poor layer parameters. Inhomogeneity is understood in the present case to mean crystal formation in individual domains which leads to RMS surface roughness of more than 5 nm (RMS roughness=root-mean-square roughness; measured by means of atomic force microscopy). This roughness firstly has an adverse effect on the layer properties of the indium oxide-containing layer (the result is in particular charge carrier mobilities which are too low for semiconductor applications), and secondly has an adverse effect on the application of further layers to obtain a component.

In contrast to the sol-gel techniques described to date, JP 11-106935 A (Fuji Photo Film Co. Ltd.) describes a process for producing a conductive metal oxide film on a transparent substrate, in which curing temperatures below 250° C., preferably below 100° C., are achieved by thermally drying a coating composition containing a metal alkoxide and/or a metal salt on a transparent substrate and then converting it with UV or VIS radiation.

However, the conversion via electromagnetic radiation used in this process has the disadvantage that the resulting layer is rippled and uneven on the surface. This results from the difficulty of achieving a homogeneous and uniform distribution of radiation on the substrate.

JP 2007-042689 A describes metal alkoxide solutions which obligatorily contain zinc alkoxides and may further contain indium alkoxides, and processes for producing semiconductor components which use these metal alkoxide solutions. The metal alkoxide films are treated thermally and converted to the oxide layer.

Pure indium oxide films cannot, however, be prepared with the metal alkoxide solutions and process described in JP 2007-042689 A. Furthermore, in contrast to indium oxide-tin oxide layers, pure indium oxide layers tend to the (partial) crystallization already mentioned, which leads to a reduced charge carrier mobility.

It is thus an object of the present invention to provide, with respect to the known prior art, a process for preparing indium oxide layers which avoids the disadvantages of the prior art cited, and is usable especially in the case of transparent indium oxide layers which are semiconductive at comparatively low temperatures and have high homogeneity and low roughness (especially an Rms roughness of 5 nm), and which is usable in printing processes.

These objects are achieved by a process for producing semiconductive indium oxide layers, in which a substrate is coated with a liquid, anhydrous composition comprising a) at least one indium alkoxide and b) at least one solvent, optionally dried and thermally treated at temperatures greater than 250° C.

An indium oxide layer in the context of the present invention is understood to mean a metallic layer which is producible from the indium alkoxides mentioned and contains essentially indium atoms or ions, the indium atoms or ions being present essentially in oxidic form. Optionally, the indium oxide layer may also contain carbene or alkoxide components from an incomplete conversion.

These semiconductive indium oxide layers producible in accordance with the invention have charge carrier mobilities in the range from 1 to 50 $cm^2/Vs$ (measured at gate-source voltage 50 V, drain-source voltage 50 V, channel width 1 cm and channel length 20 μm), which can be determined via the model of "gradual channel approximation". To this end, the formulae known from conventional MOSFETs are used. In the linear range, the following equation applies:

$$I_D = \frac{W}{L} C_i \mu \left( U_{GS} - U_T - \frac{U_{DS}}{2} \right) U_{DS} \tag{1}$$

where $I_D$ is the drain current, $U_{DS}$ is the drain-source voltage, $U_{GS}$ is the gate-source voltage, $C_i$ is the area-normalized capacitance of the insulator, W is the width of the transistor channel, L is the channel length of the transistor, μ is the charge carrier mobility and $U_T$ is the threshold voltage.

In the saturation range, there is a quadratic dependence between drain current and gate voltage, which is used in the present case to determine the charge carrier mobility:

$$I_D = \frac{W}{2L} C_i \mu (U_{GS} - U_T)^2 \tag{2}$$

Liquid compositions in the context of the present invention are understood to mean those which are in liquid form under SATP conditions ("Standard Ambient Temperature and Pressure"; T=25° C. and p=1013 hPa). Anhydrous compositions in the context of the present invention are those which contain less than 200 ppm of $H_2O$. Corresponding drying steps which lead to the establishment of correspondingly low water contents of the solvents are known to those skilled in the art.

The indium alkoxide is preferably an indium(III) alkoxide. The indium(III) alkoxide is more preferably an alkoxide having at least one C1- to C15-alkoxy or -oxyalkylalkoxy group, more preferably at least one C1- to C10-alkoxy or -oxyalkylalkoxy group. The indium(III) alkoxide is most preferably an alkoxide of the generic formula $In(OR)_3$ in which R is a C1- to C15-alkyl or -alkyloxyalkyl group, even more preferably a C1- to C10-alkyl or -alkyloxyalkyl group. This indium(III) alkoxide is more preferably $In(OCH_3)_3$, $In(OCH_2CH_3)_3$, $In(OCH_2CH_2OCH_3)_3$, $In(OCH(CH_3)_2)_3$ or $In(O(CH_3)_3)_3$. Even more preferably, $In(OCH(CH_3)_2)_3$ (indium isopropoxide) is used.

The indium alkoxide is present preferably in proportions of 1 to 15% by weight, more preferably 2 to 10% by weight, most preferably 2.5 to 7.5% by weight, based on the total mass of the composition.

The formulation further comprises at least one solvent, i.e. the formulation may comprise either one solvent or a mixture of different solvents. Usable with preference in the inventive formulation are aprotic and weakly protic solvents, i.e. those selected from the group of the aprotic nonpolar solvents, i.e. of the alkanes, substituted alkanes, alkenes, alkynes, aromatics without or with aliphatic or aromatic substituents, halohydrocarbons, tetramethylsilane, from the group of the aprotic polar solvents, i.e. of the ethers, aromatic ethers, substituted ethers, esters or acid anhydrides, ketones, tertiary amines, nitromethane, DMF (dimethylformamide), DMSO (dimethyl sulfoxide) or propylene carbonate, and of the weakly protic solvents, i.e. the alcohols, the primary and secondary amines and formamide. Solvents usable with particular preference are alcohols, and also toluene, xylene, anisole, mesitylene, n-hexane, n-heptane, tris(3,6-dioxaheptyl) amine (TDA), 2-aminomethyltetrahydrofuran, phenetole, 4-methylanisole, 3-methylanisole, methyl benzoate, N-methyl-2-pyrrolidone (NMP), tetralin, ethyl benzoate and diethyl ether.

Very particularly preferred solvents are isopropanol, tetrahydrofurfuryl alcohol, tert-butanol and toluene, and mixtures thereof.

The composition used in the process according to the invention, to achieve particularly good printability, preferably has a viscosity of 1 mPa·s to 10 Pa·s, especially 1 mPa·s to 100 mPa·s, determined to DIN 53019 Part 1 to 2 and measured at room temperature. Corresponding viscosities can be established by adding polymers, cellulose derivatives or, for example, $SiO_2$ obtainable under the Aerosil trade name, and especially by means of PMMA, polyvinyl alcohol, urethane thickeners or polyacrylate thickeners.

The substrate which is used in the process according to the invention is preferably a substrate consisting of glass, silicon, silicon dioxide, a metal oxide or transition metal oxide, a metal or a polymeric material, especially PE or PET.

The process according to the invention is particularly advantageously a coating process selected from printing processes (especially flexographic/gravure printing, inkjet printing, offset printing, digital offset printing and screen printing), spraying processes, spin-coating processes and dip-coating processes. The coating process according to the invention is most preferably a printing process.

After the coating and before the conversion, the coated substrate can additionally be dried. Corresponding measures and conditions for this purpose are known to those skilled in the art.

According to the invention, the conversion to indium oxide is effected by means of temperatures of more than 250° C. Particularly good results can be achieved, however, when temperatures of 250° C. to 360° C. are used for the conversion.

Typically, conversion times of a few seconds up to several hours are used.

The conversion can additionally be promoted by irradiating with UV, IR or VIS radiation during the thermal treatment, or treating the coated substrate with air of oxygen. It is likewise possible to contact the layer obtained after the coating step, before the thermal treatment, with water and/or hydrogen peroxide, and first convert it to a metal hydroxide in an intermediate step before the thermal conversion.

The quality of the layer obtained by the process according to the invention can additionally be further improved by a combined thermal and gas treatment (with $H_2$ or $O_2$), plasma treatment (Ar, $N_2$, $O_2$ or $H_2$ plasma), laser treatment (with wavelengths in the UV, VIS or IR range) or an ozone treatment, which follows the conversion step.

The invention further provides indium oxide layers producible using the process according to the invention.

The indium oxide layers producible using the process according to the invention are also advantageously suitable for the production of electronic components, especially the production of (thin-film) transistors, diodes or solar cells.

The examples which follow are intended to illustrate the subject-matter of the present invention in detail.

Example 1

Influence of Water

Inventive Example

A doped silicon substrate with an edge length of about 15 mm and with a silicon oxide coating of thickness approx. 200 nm and finger structures composed of ITO/gold was coated with 100 μl of a 5% by weight solution of indium(III) isopropoxide in isopropanol by spin-coating (2000 rpm). In order to exclude water, dry solvents (with less than 200 ppm of water) were used and the coating was additionally carried out in a glovebox (at less than 10 ppm of $H_2O$).

After the coating operation, the coated substrate was heat treated under air at a temperature of 350° C. for one hour.

Comparative Example

A doped silicon substrate with an edge length of about 15 mm and with a silicon oxide coating of thickness approx. 200 nm and finger structures composed of ITO/gold was coated under the same conditions as detailed above with 100 μl of a 5% by weight solution of indium(III) isopropoxide in isopropanol by spin-coating (2000 rpm), except that no dried solvents were used (water content>1000 ppm) and the coating was not performed in a glovebox but under air.

After the coating operation, the coated substrate was heat treated under air at a temperature of 350° C. for one hour.

Figure 2:
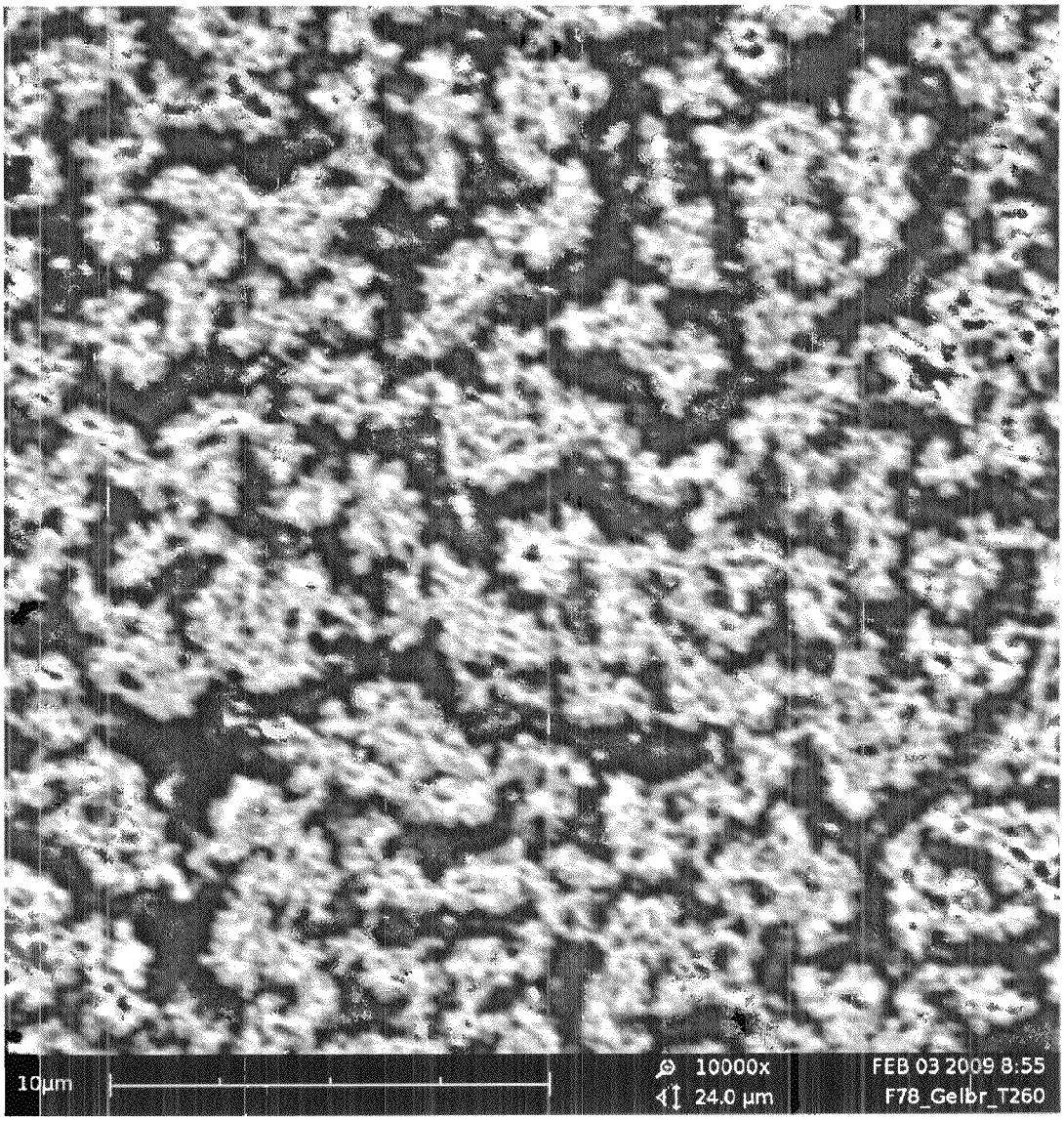

FIG. 1 shows an SEM image of the resulting $In_2O_3$ layer of the inventive coating, FIG. 2 a corresponding SEM image of the comparative example. Clearly discernible is the significantly lower roughness of the inventive layer. In addition, the layers of the comparative example are significantly less homogeneous than those of the inventive example.

The inventive coating exhibits a charge carrier mobility of 2.2 $cm^2/Vs$ (at gate-source voltage 50 V, source-drain voltage 50 V, channel width 1 cm and channel length 20 μm). In contrast, the charge carrier mobility in the layer of the comparative example is only 0.02 $cm^2Ns$ (at gate-source voltage 50 V, source-drain voltage 50 V, channel width 1 cm and channel length 20 μm).

Example 2

Temperature Influence

A doped silicon substrate with an edge length of about 15 mm and with a silicon oxide coating of thickness approx. 200 nm and finger structures of ITO/gold was coated under the same conditions as in Example 1 with 100 μl of a 5% by weight solution of indium(III) isopropoxide in isopropanol by spin-coating (2000 rpm).

After the coating operation, the coated substrate was heat treated under air at different temperatures for periods of one hour. This results in different charge carrier mobilities (measured at drain-gate voltage 50 V, source-drain voltage 50 V, channel width 1 cm and channel length 20 μm), which are compiled in Table 1 below:

TABLE 1

| Charge carrier mobilities | |
|---|---|
| Temperature [° C.] | Charge carrier mobility [$cm^2/Vs$] |
| 150 | 0.06 |
| 200 | 0.065 |

TABLE 1-continued

| Charge carrier mobilities | |
|---|---|
| Temperature [° C.] | Charge carrier mobility [$cm^2/Vs$] |
| 260 | 1.20 |
| 295 | 1.1 |
| 350 | 2.2 |

A heat treatment step with temperatures less than 250° C. does not result in usable semiconductors. Only by virtue of heat treatment at a temperature of greater than 250° C. is a suitable semiconductor produced.

The invention claimed is:

1. A process for producing a semiconductive indium oxide layer, comprising coating a substrate with a liquid, anhydrous composition comprising a) at least one indium alkoxide and b) at least one solvent, optionally drying; and thermally treating a coated substrate comprising indium alkoxide and/or indium hydroxide at temperatures greater than 250° C., wherein said liquid, anhydrous composition comprises less than 200 ppm of water.

2. A process according to claim 1, wherein, the indium alkoxide is an indium(III) alkoxide.

3. A process according to claim 2, wherein, the indium(III) alkoxide is an alkoxide with at least one C1- to C15-alkoxy or -oxyalkylalkoxy group.

4. A process according to claim 3, wherein, the indium(III) alkoxide is an alkoxide of the generic formula $In(OR)_3$ in which R is a C1- to C15-alkyl or -alkyloxyalkyl group.

5. A process according to claim 4, wherein, the indium(III) alkoxide is $In(OR)_3In(OCH_3)_3$, $In(OCH_2CH_3)_3$, $In(OCH_2CH_2OCH_3)_3$, $In(OCH(CH_3)_2)_3$ or $In(O(CH_3)_3)_3$.

6. A process according to claim 1, wherein the indium alkoxide is present in proportions of 1 to 15% by weight, based on the total mass of the composition.

7. A process according to claim 1, wherein, the at least one solvent is an aprotic or weakly protic solvent.

8. A process according to claim 7, wherein, the at least one solvent is isopropanol, tetrahydrofurfuryl alcohol, tert-butanol or toluene.

9. A process according to claim 1, wherein, the composition has a viscosity of 1 mPa·s to 10 Pa·s.

10. A process according to claim 1, wherein, the substrate consists of glass, silicon, silicon dioxide, a metal oxide or transition metal oxide or a polymeric material.

11. A process according to claim 1, wherein, the coating is affected by at least one of a printing process, spraying process, rotational coating process or a dipping process.

12. A process according to claim 1, wherein, the thermal treatment is effected at temperatures of 250° C. to 360° C.

13. The process according to claim 1, wherein said semiconductive indium oxide layer does not comprise zinc oxide.

14. An indium oxide layer produced by a process according to claim 13.

15. An electronic component comprising at least one indium oxide layer according to claim 14.

* * * * *